US010710222B1

(12) United States Patent
Utecht et al.

(10) Patent No.: US 10,710,222 B1
(45) Date of Patent: Jul. 14, 2020

(54) HYDRAULIC CYLINDER ASSEMBLY SYSTEM

(71) Applicants: Peter W. Utecht, Hartford, WI (US); Peter W. Utecht, Jr., Colgate, WI (US)

(72) Inventors: Peter W. Utecht, Hartford, WI (US); Peter W. Utecht, Jr., Colgate, WI (US)

( * ) Notice: Subject to any disclaimer, the term of this patent is extended or adjusted under 35 U.S.C. 154(b) by 0 days.

(21) Appl. No.: 16/677,929

(22) Filed: Nov. 8, 2019

(51) Int. Cl.
*B25B 27/06* (2006.01)
*B25B 27/02* (2006.01)

(52) U.S. Cl.
CPC ..... *B25B 27/02* (2013.01); *B25B 27/023* (2013.01); *B25B 27/062* (2013.01); *Y10T 29/49822* (2015.01); *Y10T 29/53861* (2015.01); *Y10T 29/53878* (2015.01)

(58) Field of Classification Search
CPC . B25B 27/023; B25B 27/062; B25B 27/0028; B25B 27/02; Y10T 29/49822; Y10T 29/53848; Y10T 29/53861; Y10T 29/4973; Y10T 29/53857; Y10T 29/53865; Y10T 29/53891; Y10T 29/4982; Y10T 29/53878; Y10T 29/53657; B23P 19/04; B23P 19/022; B23P 19/10; B23P 19/043
USPC ..... 29/256, 259, 426.5, 263, 235, 264, 222
See application file for complete search history.

(56) References Cited

U.S. PATENT DOCUMENTS 2,310,639 A * 2/1943 Johnson, Jr. ..... B25B 27/062 29/262
2,968,864 A 1/1961 Lee
4,624,041 A * 11/1986 Gathright ..... B25B 27/062 29/263
5,067,220 A * 11/1991 Combs ..... B25B 27/062 29/259
6,357,097 B1 * 3/2002 Lundgreen ..... B25B 27/023 29/263
7,010,840 B2 * 3/2006 Reale ..... B25B 27/062 29/255
9,850,943 B1 * 12/2017 Rode ..... F16B 39/04
2003/0056352 A1 * 3/2003 McLellan ..... B23P 19/025 29/252
2003/0159285 A1 * 8/2003 Utecht ..... B25B 13/06 29/888.021
2003/0217465 A1 * 11/2003 Shevela ..... B25B 27/062 29/888.061
2005/0246897 A1 * 11/2005 Zhong ..... F16C 39/02 29/898.08
(Continued)

*Primary Examiner* — Monica S Carter
*Assistant Examiner* — Mahdi H Nejad
(74) *Attorney, Agent, or Firm* — Donald J. Ersler

(57) ABSTRACT

A hydraulic cylinder assembly system preferably includes a seal installer tool, a piston puller tool and a barrel ring. The seal installer tool includes a tapered ring and a piston plug. The piston plug is inserted into the piston and seals slipped over the tapered ring. The piston puller tool preferably includes a piston rod engagement member, a thrust bearing retainer, a thrust bearing, a draw rod and a barrel end retainer. The thrust bearing is retained in the thrust bearing retainer and one end of the draw rod is retained in thrust bearing retainer. One end of the piston engagement member is threaded into the thrust bearing retainer. An opposing end of the piston engagement member is threaded into a piston rod. The barrel end retainer is threaded on to an opposing end of the draw rod. The barrel ring is attached to a barrel of a water pump.

19 Claims, 8 Drawing Sheets

(56) References Cited

U.S. PATENT DOCUMENTS

| | | | | |
|---|---|---|---|---|
| 2007/0056162 | A1* | 3/2007 | Uemura | B23P 19/088 29/788 |
| 2011/0214269 | A1* | 9/2011 | Yu | B23P 19/04 29/259 |
| 2013/0319219 | A1* | 12/2013 | Lesko | F16D 65/28 92/132 |
| 2014/0215798 | A1* | 8/2014 | Reece | B25B 27/0028 29/450 |

* cited by examiner

HYDRAULIC CYLINDER ASSEMBLY SYSTEM

BACKGROUND OF THE INVENTION

1. Field of the Invention

The present invention relates generally to hydraulic cylinders and more specifically to a hydraulic cylinder assembly system, which allows a hydraulic cylinder to be quickly and efficiently assembled.

2. Discussion of the Prior Art

U.S. Pat. No. 2,968,864 to Lee discloses an apparatus for assembling resilient seals. Patent publication no. 2014/0215798 to Reece et al. discloses a system and method for installing a seal on a work piece. The hydraulic cylinder assembly is preferably adapted for assembling a Rodder water pump, Model 2100, but could be used to assemble other pumps.

Accordingly, there is a clearly felt need in the art for a hydraulic cylinder assembly system, which allows a hydraulic cylinder to be quickly and efficiently assembled.

SUMMARY OF THE INVENTION

The present invention provides a hydraulic cylinder assembly system, which allows a hydraulic cylinder to be quickly and efficiently assembled. The hydraulic cylinder assembly system preferably includes a seal installer tool, a piston puller tool and a barrel ring. The seal installer tool includes a tapered ring and a piston plug. The piston plug extends from a rear of the tapered ring. The tapered ring includes a small diameter and a larger diameter. The small diameter is less than an inner diameter of a piston seal. The large diameter is equal to or larger than an outer diameter of a piston of a hydraulic cylinder. The piston plug is inserted into an inner diameter of the piston, until the tapered ring contacts an end of the piston. A user installs a piston seal on to opposing ends of the piston by gradually pushing and stretching the piston seal on the tapered ring with their hands. The piston seal is pushed unto the piston until it drops into a seal slot in an outer diameter of the piston. The seal installation tool includes a threaded tap. The threaded tap allows the piston plug to be extracted from the piston.

The piston puller tool preferably includes a piston rod engagement member, a thrust bearing retainer, a thrust bearing, a draw rod and a barrel end retainer. The piston rod engagement member includes a thrust retainer thread projection, a base engagement portion and a first rod thread and second rod thread. The thrust retainer thread portion extends from one end of the base engagement portion and the first rod thread extends from an opposing end of the base engagement portion. The second rod thread extends from an end of the first rod thread. A rod bore is formed through the base engagement portion to slidably receive a rotation rod. The rotation rod is axially retained in the rod bore with a set screw threaded into the base portion perpendicular to the rod bore.

The thrust bearing retainer preferably includes a rod hole, a thrust bearing bore and a retainer thread. A rod hole is formed in one end of the thrust bearing retainer and the thrust bearing bore is formed into the thrust bearing retainer, starting at an opposing end. The retainer thread is formed in the opposing end of the thrust bearing retainer. A grease threaded tap is formed perpendicular to the thrust bearing bore to threadably receive a grease zerk for lubricating the thrust bearing. The thrust bearing bore is sized to receive the thrust bearing. A retainer thread tap is formed perpendicular to the retainer thread to threadably receive a retainer set screw. The retainer set screw prevents the retainer thread projection from rotating relative to the thrust bearing retainer.

The draw rod includes a threaded shaft having a preferable one inch diameter, but other diameters may also be used. The thrust bearing is inserted into the thrust bearing bore. Then one end of the draw rod is inserted through the thrust bearing retainer and a thrust nut is threaded on to the one end of the draw rod. A roll pin or the like is inserted through the thrust nut to prevent rotation of the thrust nut relative to the draw rod. The barrel end retainer includes a length that is greater than a diameter of a hydraulic piston barrel. A threaded tap is formed through barrel end retainer to threadably receive an opposing end of the draw rod. A barrel diameter is formed on an end of the barrel end retainer to receive an inner diameter of the hydraulic piston barrel. The barrel end retainer is threaded on to the opposing end of the draw rod. A rotation nut is preferably secured to the opposing end of the draw rod with a second roll pin, welding or any other suitable method.

The barrel ring includes a first half and a second half. A barrel bore is formed in the barrel ring to receive an outer diameter of the hydraulic piston barrel of the hydraulic cylinder. A tapered bore is formed in an opposing end of the barrel ring. The tapered bore includes a large diameter and a small diameter. The large diameter is greater than an outer perimeter of the piston seal. The small diameter of the tapered bore is smaller than an inner diameter of the hydraulic piston barrel. The first half and the second half are attached to each with a plurality of barrel fasteners, but other attachment methods could also be used.

A typical hydraulic cylinder includes a center block, a piston rod, an oil piston, a water piston, an oil barrel, a water barrel, an oil end block, a water end block and a plurality of trust rods. The piston rod is slidably retained in the center block. The oil piston is attached to one end of the piston rod and the water piston is attached to an opposing end of the rod. The oil barrel is slid over the oil piston and into one end of the center block. The water barrel is slid over the water piston and into an opposing end of the center block. The oil end block is secured to the oil barrel and the water end block is secured to the water barrel. The oil and water end blocks are forced against the oil and water barrels with the plurality of trust rods.

In use, the piston seals are assembled to the oil piston as previously described. The piston puller tool is threaded into the piston rod. The rotation nut and the barrel end retainer are removed from the piston puller tool. The piston with piston seals is slid on to the draw rod. The barrel ring is attached to an end of the hydraulic piston barrel. The hydraulic piston barrel is slid over the draw rod. The barrel end retainer and the rotation nut are then reinstalled on the draw rod. The rotation nut is rotated, until the thrust bearing retainer pushes the piston into the hydraulic piston barrel through the barrel ring. The hydraulic piston barrel is pushed into the center block. The process is then repeated for the other piston and hydraulic piston barrel.

Accordingly, it is an object of the present invention to provide a hydraulic cylinder assembly system, which allows a hydraulic cylinder to be quickly and efficiently assembled.

These and additional objects, advantages, features and benefits of the present invention will become apparent from the following specification.

DETAILED DESCRIPTION OF THE PREFERRED EMBODIMENTS

Figure 1:
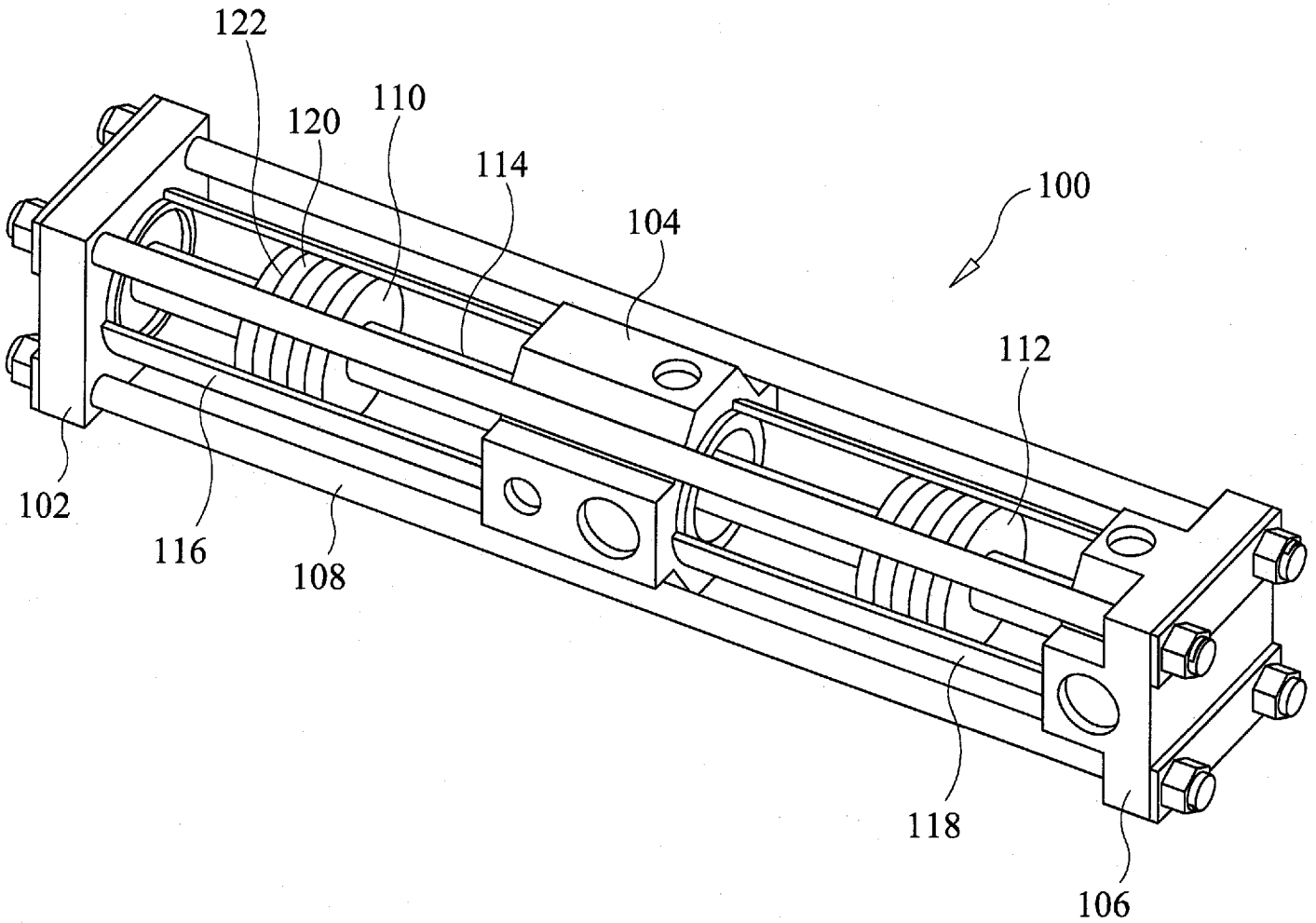
FIG. 1 (Prior Art)
FIG. 1 is a perspective cutaway view of a typical hydraulic cylinder water pump.
Figure 3:
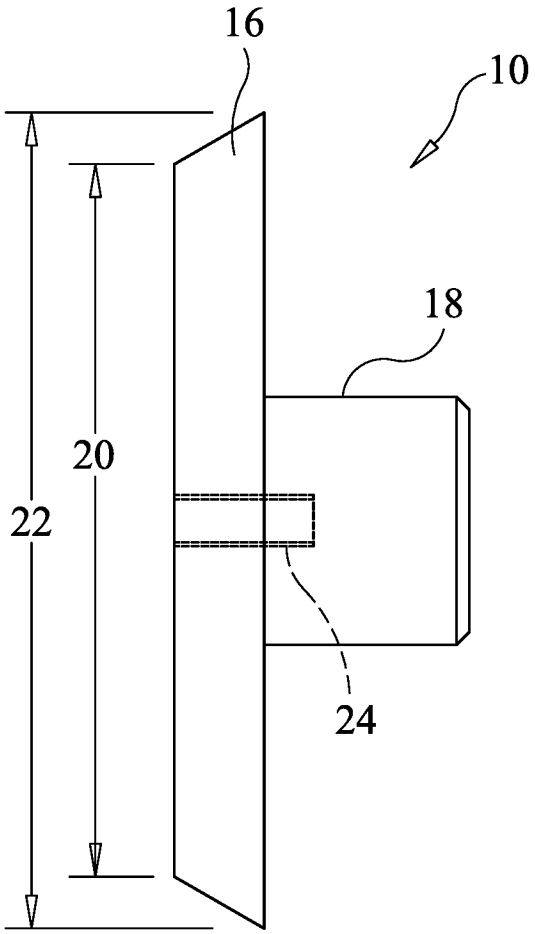
FIG. 3 is a side view of a seal installation tool of a hydraulic cylinder assembly system in accordance with the present invention.
Figure 2:
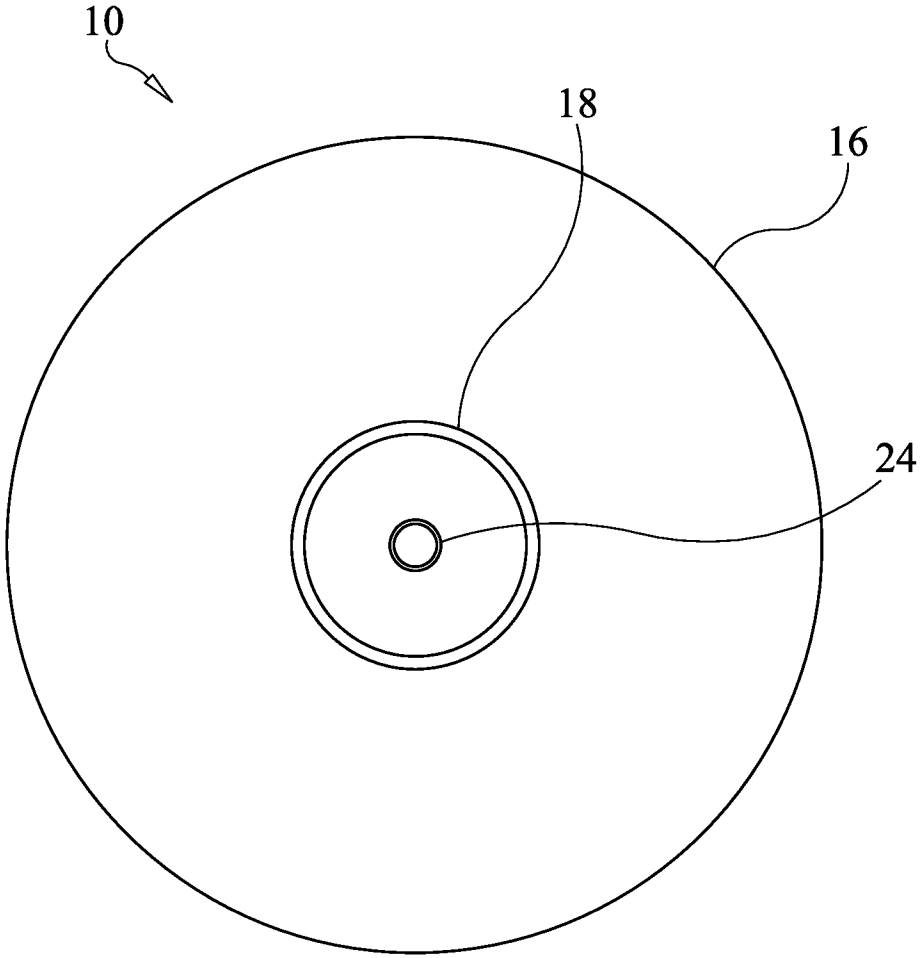
FIG. 2 is an end view of a seal installation tool of a hydraulic cylinder assembly system in accordance with the present invention.

With reference now to the drawings, and particularly to FIG. 1, there is shown a cutaway view of a typical hydraulic cylinder water pump 100. The hydraulic cylinder water pump 100 includes an oil end cap 102, a center block 104, a water end cap 106, four tension rods 108, a hydraulic piston 110, a water piston 112 and a piston rod 114, a hydraulic barrel 116 and a water barrel 118. With reference to FIGS. 2-11, a hydraulic cylinder assembly system preferably includes a seal installer tool 10, a piston puller tool 12 and a barrel ring 14. With reference to FIGS. 2-3, the seal installer tool 10 includes a tapered ring 16 and a piston plug 18. The piston plug 18 extends from a rear of the tapered ring 16. The tapered ring 16 includes a small diameter 20 and a larger diameter 22. The small diameter 20 is less than an inner diameter of a piston seal 120. The large diameter 22 is equal to or larger than an outer diameter of the piston 110, 112 of the hydraulic cylinder water pump 100. The piston plug 18 is inserted into an inner diameter of the piston 110, 112, until the tapered ring 16 contacts an end of the piston 110, 112. A user installs a piston seal 120 on to opposing ends of the piston 110, 112 by gradually pushing and stretching the piston seal 120 on the tapered ring 16 with their hands. The piston seal 120 is pushed unto the piston 110, 112 until the piston seal 120 drops into a seal slot 122 in an outer diameter of the piston 110, 112. The seal installation tool 10 also includes a threaded tap 24 formed in the tapered ring. The threaded tap 24 allows the piston plug 18 to extracted from the piston 110, 112.

Figure 4:
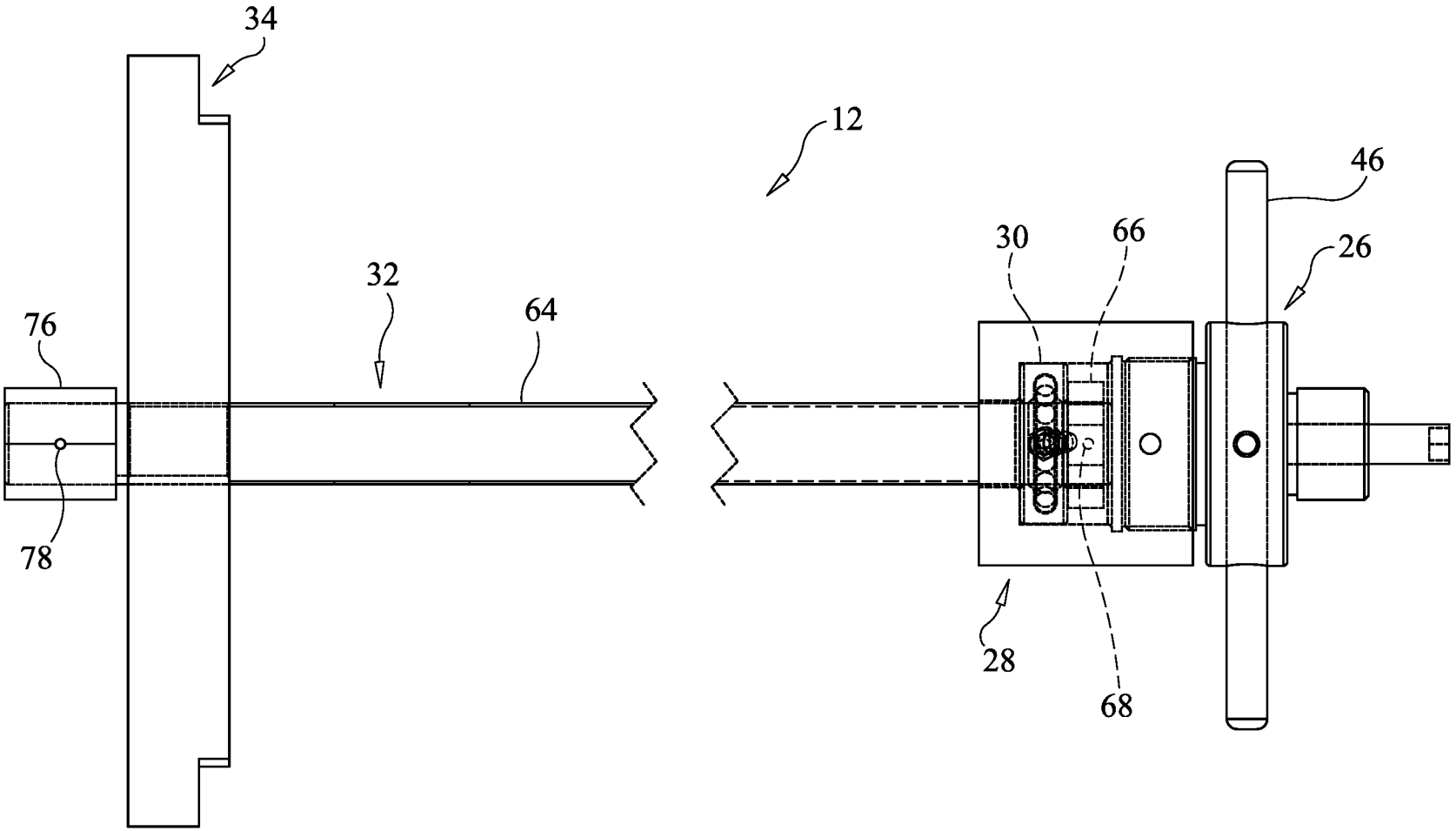
FIG. 4 is a side view of a piston puller tool of a hydraulic cylinder assembly system in accordance with the present invention.
Figure 6:
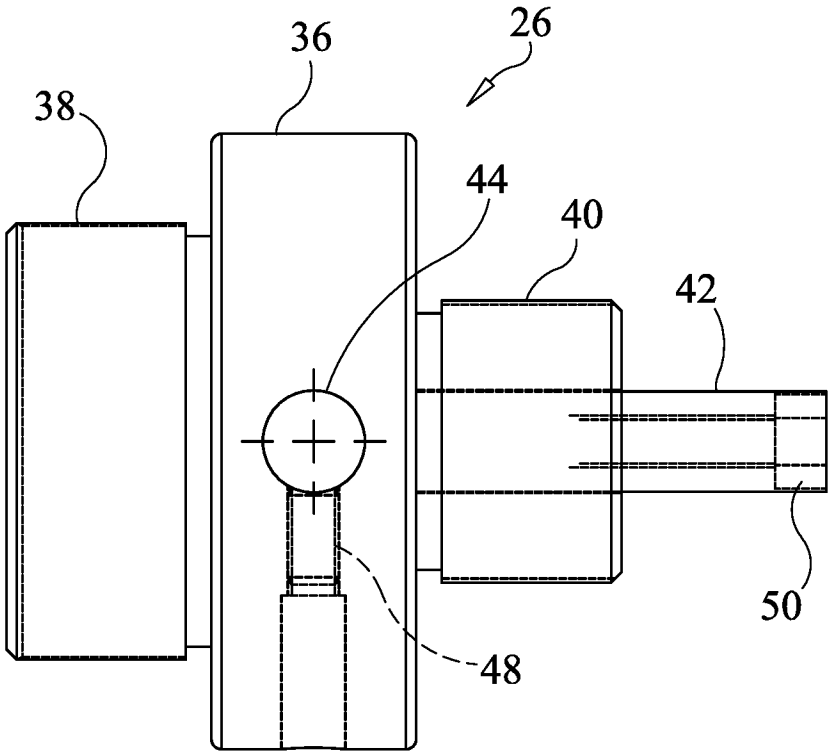
FIG. 6 is a side view of a piston rod engagement member of a hydraulic cylinder assembly system in accordance with the present invention.
Figure 5:
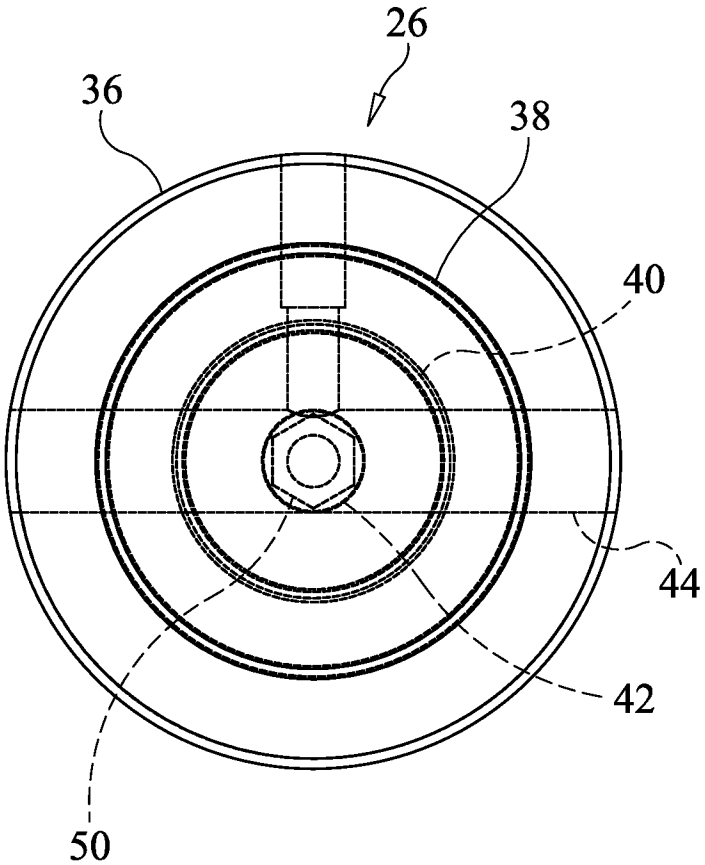
FIG. 5 is an end view of a piston rod engagement member of a hydraulic cylinder assembly system in accordance with the present invention.

With reference to FIG. 4, the piston puller tool 12 preferably includes a piston rod engagement member 26, a thrust bearing retainer 28, a thrust bearing 30, a draw rod 32 and a barrel end retainer 34. With reference to FIGS. 5-6, the piston rod engagement member 26 includes a base engagement member 36, a thrust retainer thread projection 38, a first threaded rod plug 40 and a second threaded rod plug 42. The thrust retainer thread projection 38 extends from one end of the base engagement member 36 and the first threaded rod plug 40 extends from an opposing end of the base engagement member 36. The second threaded rod plug 42 extends from an end of the second threaded rod plug 42. A rod bore 44 is formed through the base engagement portion 36 to slidably receive a rotation rod 46. The rotation rod 46 is axially retained in the rod bore with a set screwed 48 threaded into the base engagement portion 36, perpendicular to the rod bore 44. At least one pair of flat surfaces 50 are preferably formed on an end of the second threaded rod plug 42 to allow the piston rod engagement member 26 to screwed into the thrust bearing retainer or removed therefrom.

Figure 8:
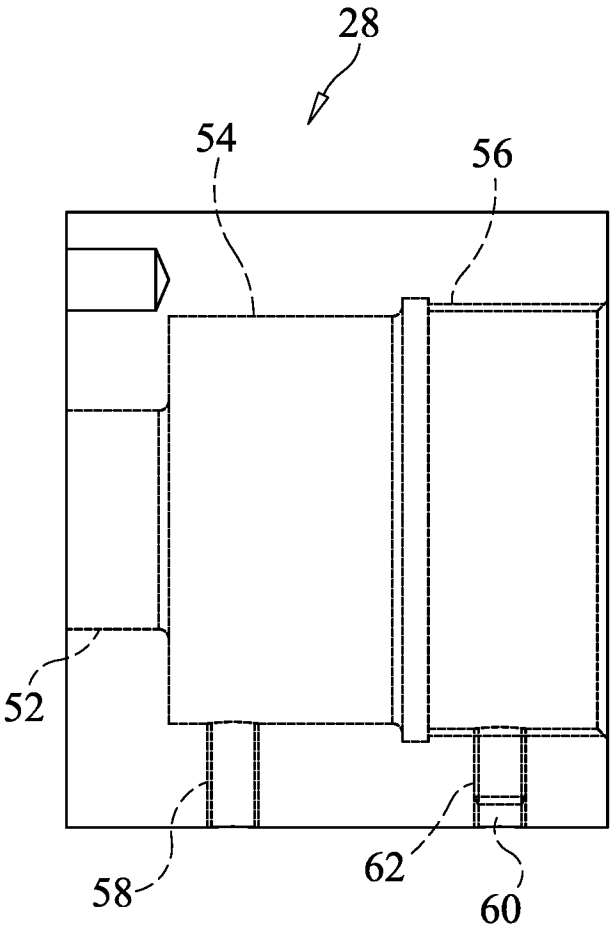
FIG. 8 is a side view of a thrust bearing retainer of a hydraulic cylinder assembly system in accordance with the present invention.
Figure 7:
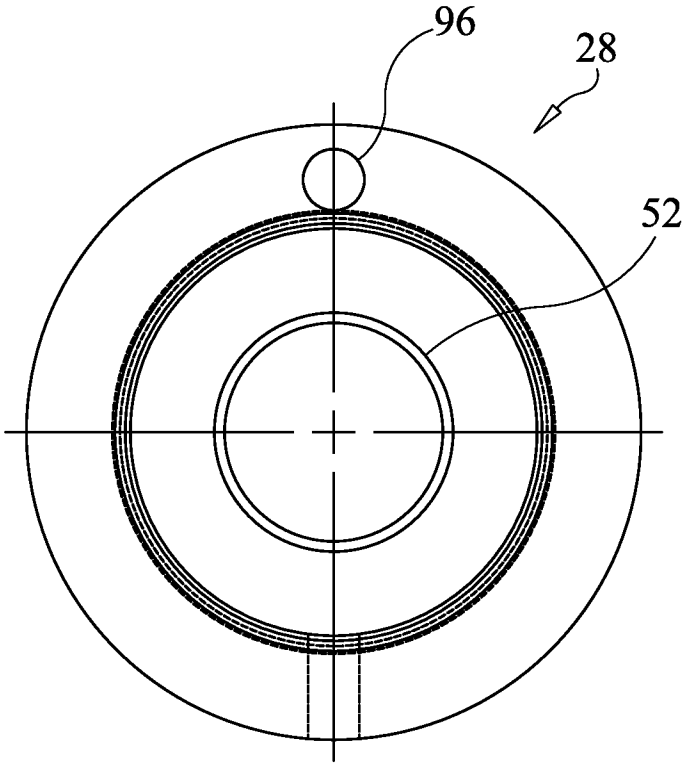
FIG. 7 is an end view of a thrust bearing retainer of a hydraulic cylinder assembly system in accordance with the present invention.

With reference to FIGS. 7-8, the thrust bearing retainer 28 preferably includes a rod hole 52, a thrust bearing bore 54 and a retainer thread 56. A rod hole 52 is formed in one end of the thrust bearing retainer 28 and the thrust bearing bore 54 is formed into the thrust bearing retainer 28, starting at an opposing end. The retainer thread 56 is formed in the opposing end of the thrust bearing retainer 28. A grease threaded tap 58 is formed perpendicular to the thrust bearing bore 54 to threadably receive a grease zerk (not shown) for lubricating the thrust bearing 30. The thrust bearing bore 54 is sized to receive the thrust bearing 30. A retainer thread tap 60 is formed perpendicular to the retainer thread to threadably receive a retainer set screw 62. The retainer set screw 62 prevents the thrust retainer thread projection 38 from rotating relative to the thrust bearing retainer 28.

The draw rod 32 includes a threaded shaft 64 being preferably one inch in diameter, but other diameters may also be used. The thrust bearing 30 is inserted into the thrust bearing bore 54. Then, one end of the draw rod 32 is inserted through the thrust bearing 30 retainer and a thrust nut 66 is threaded on to the one end of the draw rod 32. A roll pin 68 or the like is inserted through the thrust nut 66 (when the thrust nut 66 is outside the thrust bearing retainer 28) to prevent rotation of the thrust nut 66 relative to the draw rod 32.

Figure 9:
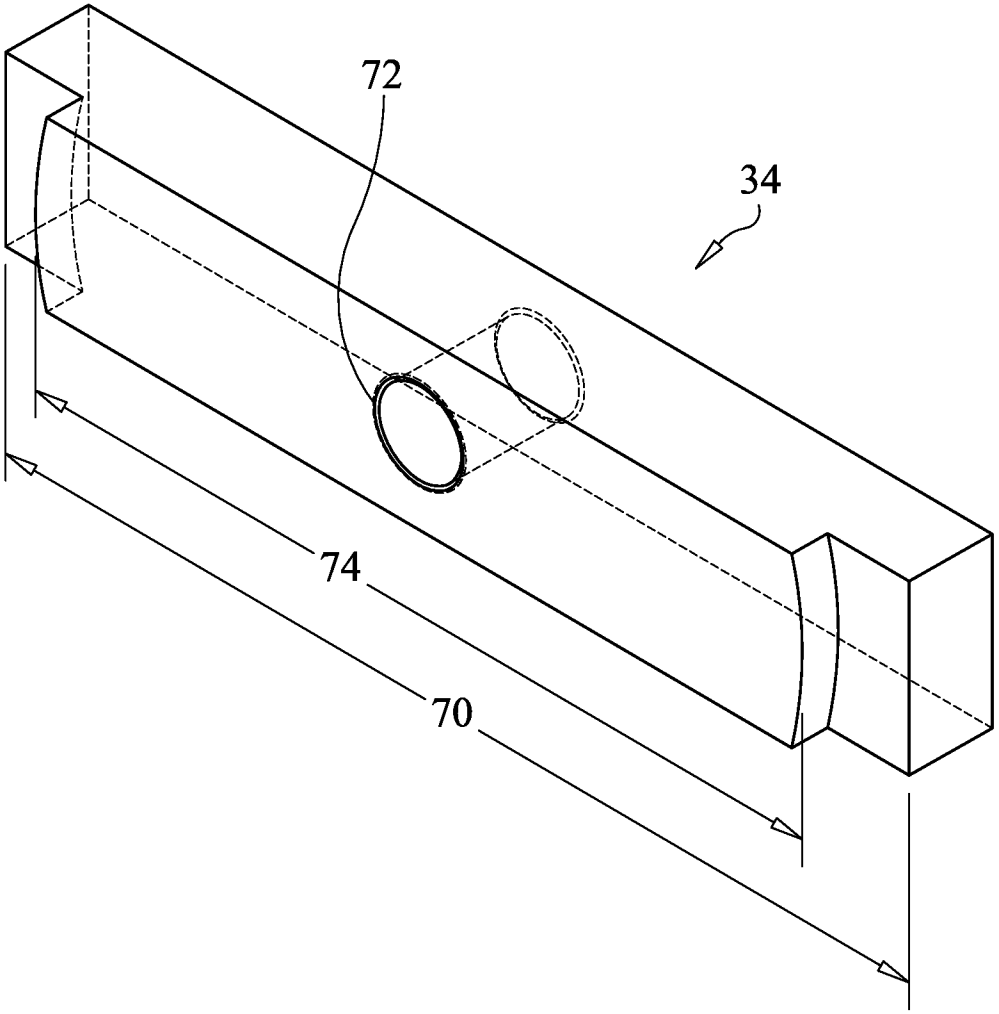
FIG. 9 is a perspective view of a barrel end retainer of a hydraulic cylinder assembly system in accordance with the present invention.

With reference to FIG. 9, the barrel end retainer 34 includes a length 70 that is greater than a diameter of a piston barrel 116, 118. A threaded tap 72 is formed through barrel end retainer 34 to threadably receive an opposing end of the draw rod 32. A barrel diameter 74 is formed on an end of the barrel end retainer 34 to receive an inner diameter of the piston barrel 116, 118. The barrel end retainer 34 is threaded on to the opposing end of the draw rod 32. A rotation nut 76 is threaded on to the draw rod, after the barrel end retainer 34. The rotation nut 76 is preferably secured to the opposing end of the draw rod 32 with a roll pin 78, welding or any other suitable method.

Figure 11:
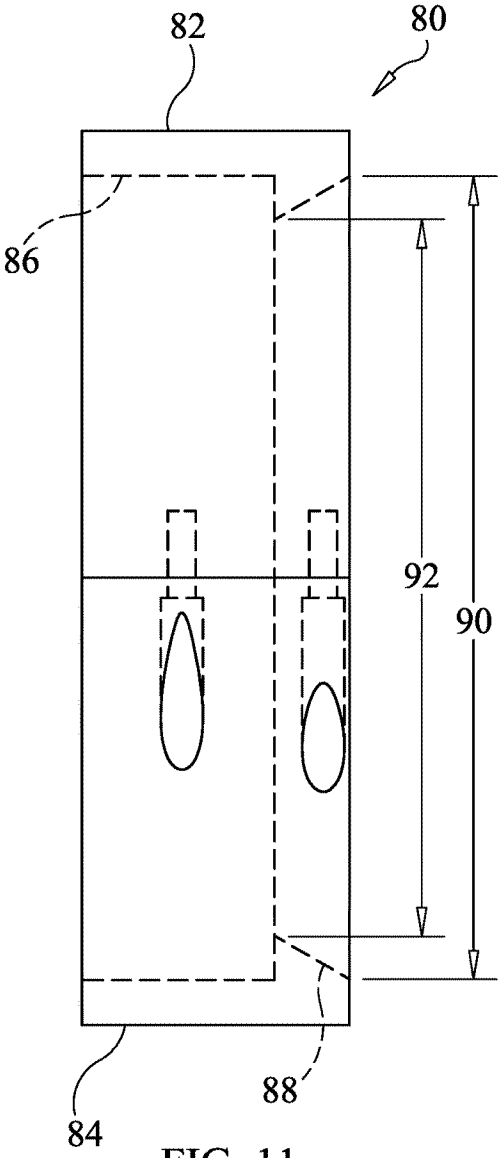
FIG. 11 is a side view of a barrel ring of a hydraulic cylinder assembly system in accordance with the present invention.
Figure 10:
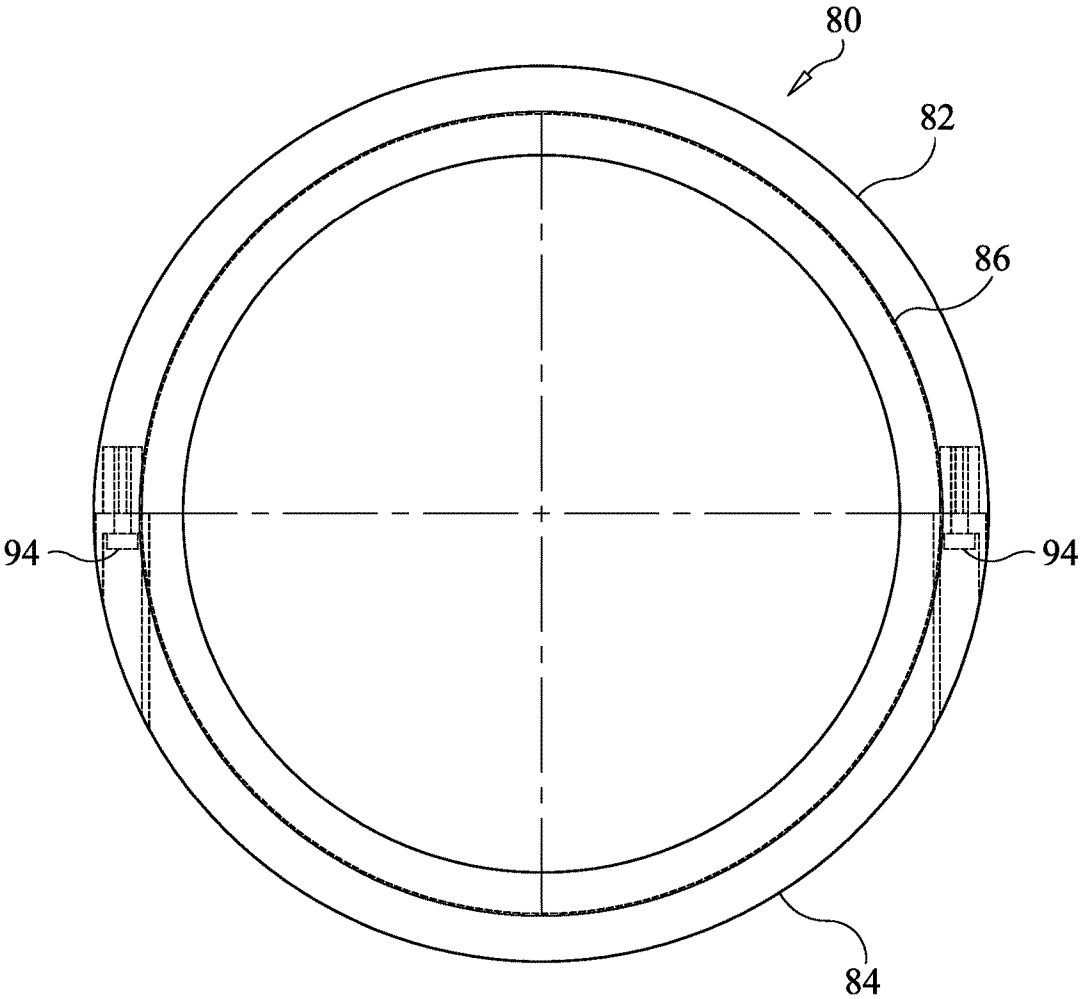
FIG. 10 is an end view of a barrel ring of a hydraulic cylinder assembly system in accordance with the present invention.

With reference to FIGS. 10-11, the barrel ring 80 includes a first half 82 and a second half 84. A barrel bore 86 is formed into the barrel ring 80 to receive an outer diameter of the barrel 116, 118 of the hydraulic cylinder water pump 100. A tapered bore is formed in an opposing end of the barrel ring 80. The tapered bore 88 includes a large diameter 90 and a small diameter 92. The large diameter 90 is greater than an outer perimeter of the piston seal 120. The small diameter 92 of the tapered bore 88 is smaller than an inner diameter of the barrel 116, 118. The first half 82 and the second half 84 are attached to each with a plurality of barrel fasteners 94, but other attachment methods may also be used.

With reference to FIG. 1, the piston rod 114 is slidably retained in the center block 104. The oil piston 110 is attached to one end of the piston rod 114 and the water piston 112 is attached to an opposing end of the piston rod 114. The oil barrel 116 is slid over the oil piston 110 and into one end of the center block 104. The water barrel 118 is slid over the water piston 112 and into an opposing end of the center block 104. The oil end block 102 is secured to the oil barrel and the water end block 106 is secured to the water barrel 118. The oil and water end blocks 102, 106 are forced against the oil and water barrels 116, 118 with the plurality of tension rods 108.

Figure 12:
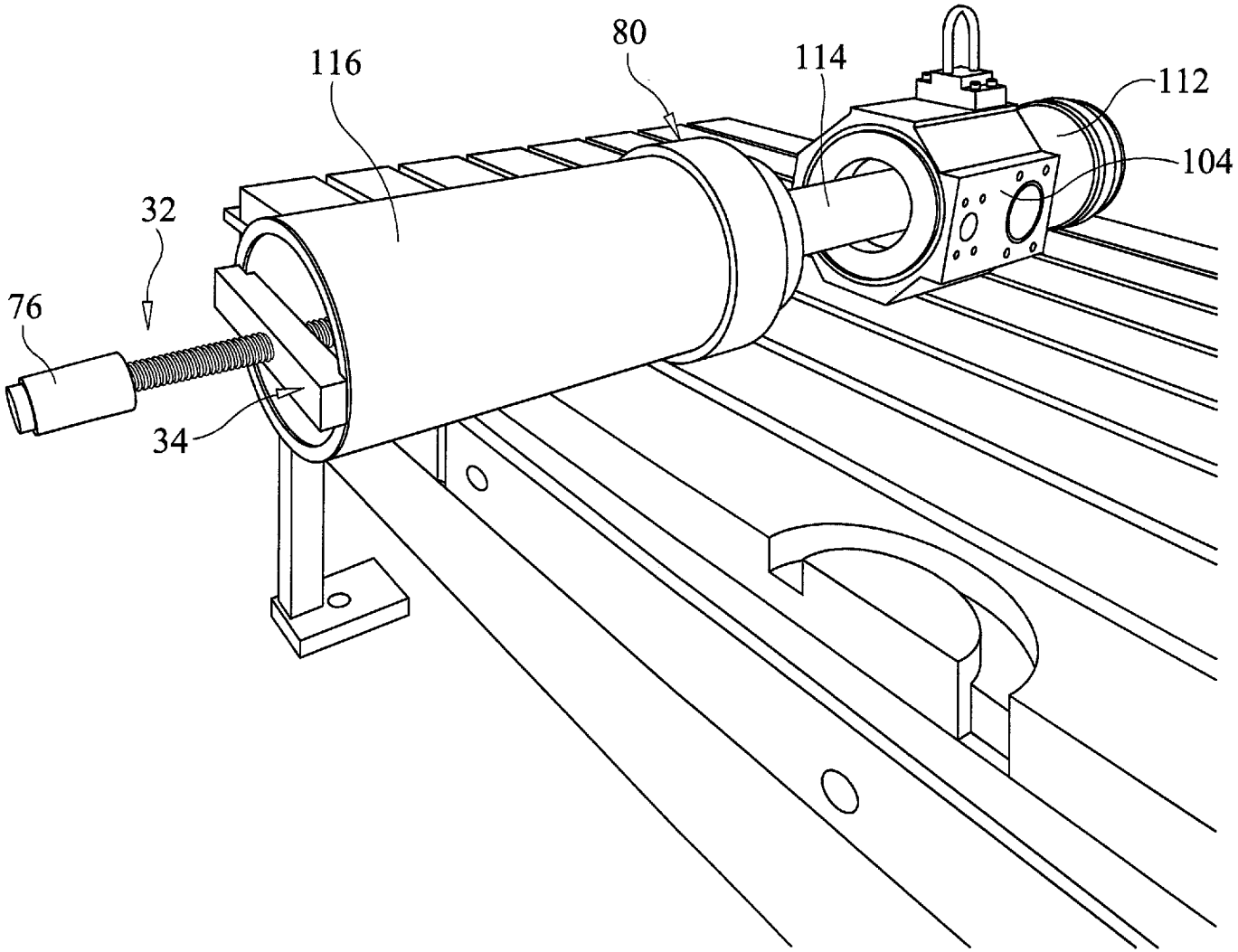
FIG. 12 is a perspective view of a barrel ring attached to an oil barrel and a piston puller tool engaged with a piston rod of a hydraulic water pump, after an oil piston has been pushed into the oil barrel in accordance with the present invention.

With reference to FIG. 12, the piston seals 120 are assembled to the oil and water pistons 110, 112 as previously described. The first threaded rod plug 40 or the second threaded rod plug 42 of the piston puller tool 12 is threaded into the oil piston 110 or the water piston 112, respectively. The rotation nut 76 and the barrel end retainer 34 are removed from the piston puller tool 12. The oil piston 110 with the piston seals 120 is slid on to the draw rod 32, adjacent the thrust bearing retainer 28. The barrel ring 80 is attached to an end of the oil barrel 116. The oil barrel 116 is slid over the draw rod 32. The barrel end retainer 34 and the rotation nut 76 are then reinstalled on the draw rod 32. The rotation nut 76 is rotated, until the thrust bearing retainer 28 forces the oil piston 110 through the barrel ring 80 and into the oil barrel 116. The oil barrel 116 is pushed into the center block 104. A rod (not shown) may be inserted into a rod hole 96 in the thrust bearing retainer 28 to prevent rotation thereof, while rotating the rotation nut 76. The process is then repeated for the water piston 112 and the water barrel 118.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A piston puller tool for installing a piston into a barrel of a hydraulic cylinder, comprising:

a piston rod engagement member includes a base engagement member, a thrust retainer projection, at least one threaded rod plug, said thrust retainer projection extends from one end of said base engagement member, said at least one threaded rod plug extends from an opposing end of said base engagement member, wherein said piston rod engagement member is engaged with the piston;

a thrust bearing retainer includes a rod bore formed through one end, a bearing bore is formed into said thrust bearing retainer starting at an opposing end to receive a thrust bearing, said thrust retainer projection is engaged in an entrance to said bearing bore;

a draw rod having one end retained in said thrust bearing retainer; and a barrel end retainer is threadably retained on an opposing end of said draw rod, said barrel end retainer includes a barrel perimeter, said barrel perimeter is sized to receive an inner diameter of the barrel.

2. The piston puller tool of claim 1 wherein:

said at least one threaded rod plug includes a second threaded rod plug extending from an end thereof.

3. The piston puller tool of claim 2 wherein:

at least one pair of parallel flat surfaces are formed on an end of said second threaded rod plug.

4. The piston puller tool of claim 1, further comprising:

a seal installer tool includes a tapered ring and a piston plug, said piston plug extends from a rear of said tapered ring, wherein said piston plug is sized to be received by the piston for installation of piston seals.

5. The piston puller tool of claim 1, further comprising:

a thrust nut is retained on said one end of said draw rod, said thrust nut is located between said thrust bearing and said thrust retainer projection.

6. The piston puller tool of claim 1, further comprising:

a rotation nut is retained said opposing end of said draw rod, said rotation nut is used to rotate said draw rod.

7. The piston puller tool of claim 1, further comprising:

a rotation rod is removably retained in said base engagement portion.

8. A piston puller tool for installing a piston into a barrel of a hydraulic cylinder, comprising:

a piston rod engagement member includes a base engagement member, a thrust retainer threaded projection, at least one threaded rod plug, said thrust retainer threaded projection extends from one end of said base engagement member, said at least one threaded rod plug extends from an opposing end of said base engagement member, wherein said at least one threaded rod plug is sized to be threaded into a piston rod of the hydraulic cylinder;

a thrust bearing retainer includes a rod bore formed through one end, a bearing bore is formed into said thrust bearing retainer starting at an opposing end to receive a thrust bearing, a retainer thread is formed in said opposing end of said thrust bearing retainer to threadably receive said thrust retainer threaded projection;

a draw rod having one end retained in said thrust bearing retainer; and a barrel end retainer is threadably retained on an opposing end of said draw rod, wherein said barrel end retainer is sized to receive an end of a barrel of the hydraulic cylinder.

9. The piston puller tool of claim 8 wherein:

said at least one threaded rod plug includes a second threaded rod plug extending from an end thereof.

10. The piston puller tool of claim 9 wherein:

at least one pair of parallel flat surfaces are formed on an end of said second threaded rod plug.

11. The piston puller tool of claim 8, further comprising:

a seal installer tool includes a tapered ring and a piston plug, said piston plug extends from a rear of said tapered ring, wherein said piston plug is sized to be received by the piston for installation of piston seals.

12. The piston puller tool of claim 8, further comprising:

a thrust nut is retained on said one end of said draw rod, said thrust nut is located between said thrust bearing and said thrust retainer projection.

13. The piston puller tool of claim 8, further comprising:

a rotation nut is retained on said opposing end of said draw rod, said rotation nut is used to rotate said draw rod.

14. The piston puller tool of claim 8, further comprising:

a rotation rod is removably retained in said base engagement portion.

15. A piston puller tool for installing a piston into a barrel of a hydraulic cylinder, comprising:

a piston rod engagement member includes a base engagement member, a thrust retainer projection, at least one threaded rod plug, said thrust retainer projection extends from one end of said base engagement member, said at least one threaded rod plug extends from an opposing end of said base engagement member;

a thrust bearing retainer includes a rod bore formed through one end, a bearing bore is formed into said thrust bearing retainer starting at an opposing end to receive a thrust bearing, said thrust retainer projection is engaged in an entrance of said bearing bore;

wherein said piston rod engagement member is engaged with the piston a draw rod having one retained in said thrust bearing retainer;

a barrel end retainer is threadably retained on an opposing end of said draw rod; and a barrel ring includes a first ring half and a second ring half, an inner perimeter of said first and second ring halves are sized to receive the barrel, said first ring half is secured to said second ring half to retain the barrel.

16. The piston puller tool of claim 15 wherein:

a tapered bore is formed in an opposing end of barrel ring.

17. The piston puller tool of claim 15 wherein:

said at least one threaded rod plug includes a second threaded rod plug extending from an end thereof.

18. The piston puller tool of claim 15, further comprising:

a seal installer tool includes a tapered ring and a piston plug, said piston plug extends from a rear of said tapered ring, wherein said piston plug is sized to be received by the piston for installation of piston seals.

19. The piston puller tool of claim 15, further comprising:

a thrust nut is retained on said one end of said draw rod, said thrust nut is located between said thrust bearing and said thrust retainer projection.

* * * * *